US007690608B2

(12) United States Patent
Huber

(10) Patent No.: US 7,690,608 B2
(45) Date of Patent: Apr. 6, 2010

(54) ATTACHMENT DEVICE FOR SHEET MATERIAL

(76) Inventor: W. Rene Huber, 42 Mill Glen Rd., Upper Saddle River, NJ (US) 07458

( * ) Notice: Subject to any disclaimer, the term of this patent is extended or adjusted under 35 U.S.C. 154(b) by 1082 days.

(21) Appl. No.: 11/146,633

(22) Filed: Jun. 7, 2005

(65) Prior Publication Data

US 2005/0269816 A1 Dec. 8, 2005

Related U.S. Application Data

(60) Provisional application No. 60/577,933, filed on Jun. 8, 2004.

(51) Int. Cl.
*A47G 29/00* (2006.01)
*G09F 23/10* (2006.01)

(52) U.S. Cl. ..... 248/205.3; 40/340; 40/630; 40/641; 248/447.1; 248/683; 281/44

(58) Field of Classification Search ..... 248/205.3, 248/214, 467, 447.1, 205.1, 683, 306, 216.1; 428/132, 343; 40/641, 642.01, 642.02, 630, 40/625, 644, 360; 281/44
See application file for complete search history.

(56) References Cited

U.S. PATENT DOCUMENTS 1,560,029 A 11/1925 Erickson
2,081,095 A * 5/1937 Mull ..... 248/467
3,458,946 A 8/1969 Lasswell
3,884,443 A 5/1975 McMaster
4,260,056 A * 4/1981 Horvath et al. ..... 206/370
4,477,048 A * 10/1984 Conway ..... 248/447.1
4,736,917 A 4/1988 Thuresson
5,462,782 A 10/1995 Su
5,707,032 A * 1/1998 Ehrlich ..... 248/205.3
5,890,688 A 4/1999 Riordan
6,082,777 A * 7/2000 Grosskopf et al. ..... 283/81
6,382,569 B1 * 5/2002 Schattner et al. ..... 248/74.1
6,517,038 B1 * 2/2003 Pomerantz ..... 248/214
6,613,382 B1 9/2003 Lee
7,040,051 B2 * 5/2006 Windorski ..... 40/641
2003/0232190 A1 * 12/2003 O'Leary et al. ..... 428/343
2005/0012003 A1 1/2005 Jackson et al.

* cited by examiner

*Primary Examiner*—J. Allen Shriver
*Assistant Examiner*—Tan Le
(74) *Attorney, Agent, or Firm*—Gerald E. Hespos; Anthony J. Casella

(57) ABSTRACT

A mounting assembly is provided for securing objects to a substrate in a manner that permits the objects to be removed from the mounting assembly and from the substrate. The mounting assembly includes a planar sheet-like holder with opposite front and rear faces. A repositionable adhesive is applied across the entire rear face of the holder, and the holder is removably disposed on a release liner. A generally U-shaped cut is formed in the holder to define a flap. The flap can be repositionably attached to the object, while remaining portions of the holder can be repositionably secured to a substrate.

9 Claims, 6 Drawing Sheets

ATTACHMENT DEVICE FOR SHEET MATERIAL

This application claims priority on U.S. Provisional Patent Appl. No. 60/577,933, filed Jun. 8, 2004.

BACKGROUND OF THE INVENTION

1. Field of the Invention

The invention relates to a holder with an adhesive that exhibits temporary and permanent adhesive characteristics for removably and repositionably holding an object on a substrate.

2. Description of the Related Art

There are many instances when an object must be supported at least temporarily on a substrate. The substrate may be a wall, a door, a cabinet, a desk, a computer, a notebook or the like. The object to be retained on the substrate also can take many forms, such as a photograph, a poster, a calendar, a memorandum, a recipe, a business card, a wire, a decoration or the like.

Objects that are intended for fairly permanent mounting on a substrate may be framed and mounted with picture hooks or other types of mounting hardware that are nailed, screwed or otherwise permanently embedded in the substrate. Other objects may be adhered to the substrate with a permanent adhesive.

There are many other instances where the object will be mounted to the substrate for only a limited duration. For example, a college student may want to decorate a dorm room with posters or photographs. However the dorm room wall must be substantially in its initial condition at the end of the school year. Hence, nails, screws and the like generally are not suitable for mounting objects on the walls of a college dorm room. Additionally, most students and their parents would prefer not to invest significant amounts of money to frame the various posters and photographs that a college student is likely to display in a dorm room.

Push pins sometimes are used to tack a poster, photograph or calendar to a wall. However, push pins damage the object that is to be mounted and inflict at least minimal damage to the wall or other substrate. Furthermore, many walls are too hard to accept a push pin.

Adhesive tape often is used to mount sheet material, such as posters and photographs, on a wall. The tape may be stretched across the corners of the poster, photograph or other sheet shaped object that is being mounted. However, this mounting method is unsightly and will permanently damage the front face of the object that is mounted. Additionally, many types of adhesive tape leave a residue on the substrate. The residue often is difficult to remove and will retain dirt if not removed completely. Adhesive tape can be formed into a loop with the adhesive surface facing outwardly. Several such loops of adhesive tape then can be affixed to the rear face of the poster, photograph or other sheet shaped object. The poster or photograph then is pressed against the wall. This approach avoids the unsightly appearance of tape stretching across the external corners of the sheet. However, the tape still may leave a residue when the poster, photograph or the like is removed. Furthermore, it is difficult to remove the sheet from the wall and it is difficult to remove the tape from the sheet without permanently damaging the poster, photograph or other such sheet. Double-sided adhesive tape can be used in place of the above-described loops of one-sided adhesive tape. However, double-sided adhesive tape suffers from the same problems as the adhesive tape loops.

The above-described mounting needs and problems occur in many environments other than college dorms. For example, younger children often want to display photographs or posters that are relevant to the particular age of the child. The poster or photographs quickly become dated and passe as the child moves from one age bracket to another and as popular culture evolves.

Kitchens, family rooms and doors in homes are other common places for displaying calendars, notes, photographs, report cards, recipes and the like. Most such mountings are very temporary in nature and should be carried out to avoid damage to either the substrate or the object that is being mounted.

A demand also exists for mounting objects to a substrate in the workplace. For example, a weekly or monthly to-do-list often is mounted prominently, but is changed frequently. A business card may be removably mounted to an office door or to a brochure that is being delivered to a customer. Permanent adhesives and permanent adhesive tapes are undesirable for most of these applications. In particular, most permanent adhesives and adhesive tapes will damage both the substrate and the object that is being temporarily affixed to the substrate.

Rubber-like removable adhesive blocks are useful for some situations. These blocks come in many different plan view configurations including squares, circles and elongate strips. The thickness varies from proximally ⅛-¼ inch. These adhesive products can be pressed against the rear surface of the object to be mounted. The object then is pressed against the substrate. These adhesive products generally can be removed without permanently damaging a wall door, cabinet or the like. However, a thin flexible object, such as a poster, photograph, memorandum, calendar or such is likely to be torn or delaminated in an attempt to remove the object from the substrate or in an attempt to remove the adhesive block from the object. The bulkiness of these adhesive blocks also can cause visually apparent lumps when applied to a thin object, such as a poster or photograph.

Post-it® notes are used widely for writing short memoranda, comments or instructions and can be affixed removably to some substrates. The Post-it® notes generally are rectangular sheets with a thin area of a repositionable adhesive along one edge. The sheets are held in a pad form by the removable adhesive. The note sheets then can be removed one-by-one and temporarily affixed to a substrate. The user then can write a short note on the Post-it®. Post-it® notes generally are not well-suited for supporting an object on a substrate.

In view of the above, it is an object of the subject invention to provide holders for mounting an object removably to a substrate.

It is another object of the invention to provide a method for mounting an object on a substrate.

SUMMARY OF THE INVENTION

The invention relates to a flexible holder sheet having opposite front and rear surfaces. The holder sheet may be formed from paper, plastic, fabric, foil or any other flexible material, and may be opaque or at least partly transparent. The holder may be a single unitary sheet or a laminated sheet. The front surface of the holder sheet may be plain or printed, smooth or textured. The rear surface of the holder sheet is coated with a layer of a removable adhesive, such as the adhesives that often are referred to commercially as temporary/permanent adhesives. In this regard, a temporary/permanent adhesive is considered to be an adhesive that will securely hold the sheet to a substrate and/or to an object for an indefinite and long period of time. However, this adhesive also can be separated from the surface to which the sheet is adhered without damaging the surface and without leaving a residue on the surface. Additionally, the temporary/permanent adhesive should permit the holder to be repositioned and removably adhered a plurality of times before losing its adhesiveness. The temporary/permanent adhesive preferably is applied across the entire rear surface of the holder sheet, but may be partially coated or pattern coated to achieve a particular grip specification depending upon the characteristics of the sheet and the substrate. The rear surface of the holder also may be pre-coated depending upon the characteristics of the material from which the holder is formed and depending upon the desired adhesive characteristics. For example, a holder formed from paper is more likely to require a pre-coating than a holder formed from a plastic or foil. Coating materials will be known to those skilled in this art and will be selected in accordance with the material chosen for the holder, the adhesive selected and the desired adhesive characteristics of the holder.

The holder sheet may be substantially rectangular and in many instances may be substantially square. However, other configurations are equally effective and the skilled artisan will develop configurations for a particular purpose. For example, the sheet material could be die-cut and printed to resemble a hand, the mouth of a person or animal, the door of a building or many other shapes and designs.

The holder sheet includes at least one die-cut extending entirely therethrough at a location within the area bounded by the periphery of the holder sheet. The die-cut preferably is non-linear and most preferably defines a generally U-shape. Thus, the die-cut defines a flap that can be lifted from a foot formed by the remainder of the sheet. Some holder constructions may be achieved with a single straight cut rather than the non-linear cut. With these designs, the functional equivalent of the flap will be a generally triangular area that has the straight cut as one side of the triangle. The foot will be defined by the remainder of the holder sheet surrounding the triangular equivalent of the flap. With all embodiments, the ratio of the area of the flap to the area of the foot will be selected in accordance with the characteristics of the substrate and the object. A holder intended to support objects on a non-smooth substrate (e.g., a cement block wall) may require the foot to occupy a larger percentage of the total surface area of the holder sheet. On the other hand, a holder sheet intended to support a relatively heavy object (e.g., a calendar) on a relatively smooth wall may require the flap to occupy a relatively larger area of the holder sheet.

The holder sheet can be used by lifting the flap upwardly from the remainder of the sheet. The edge of an object that will be secured to a substrate then can be slid between the rear surface of the flap and the front surface of the foot adjacent to the die-cut that forms the flap. The flap then is pressed down towards the foot defined by the remainder of the sheet. Thus, the flap achieves a removable attachment with the edge of the object that is to be secured to the substrate. The sheet then is pressed against the substrate, such as a wall, door, desk, computer screen, brochure or the like and is held repositionably on the substrate by the adhesive. A plurality of such sheets can be used simultaneously in this manner to secure larger items, such as a poster.

The items secured by the holder can be moved from one location on the substrate to another merely by peeling the one or more holders from the substrate and moving the combined holders and object to a new location on the substrate or to a different substrate. The holders will not damage the substrate and will not leave residue on the substrate. The holders then are merely pressed against the substrate in the repositioned location. This ability to reposition the holders and the object is particularly useful, for example, when the holders are used to hang photographs, posters or the like. Thus, a photograph can be hung in a first location and subsequently can be moved to accommodate additional photographs or simply to move a photograph from a less preferred position to a more preferred position.

The holders may be attached to a release liner and may be peeled from the release liner when needed. Separate release liners may be stacked and packaged and may be dispensed sequentially from the package. Alternatively, an elongate strip of release liner material can be perforated between adjacent holders and can be folded into Z-shaped array or wound onto a core. The release liner can be torn along the perforation line as holders are needed. The holder then is peeled from the release liner for use in holding an object on a substrate.

DETAILED DESCRIPTION OF THE PREFERRED EMBODIMENTS

Figure 1:
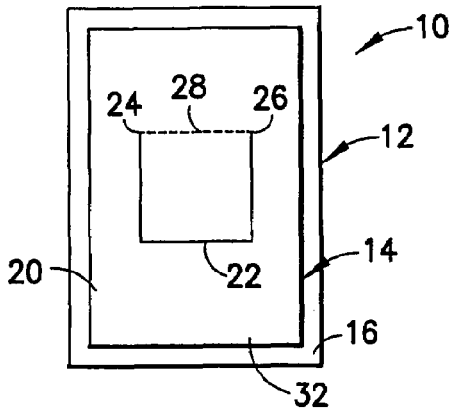
FIG. 1 is a top plan view of a mounting assembly in accordance with the subject invention.
Figure 2:
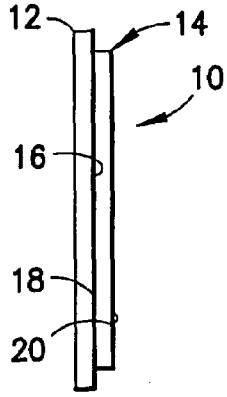
FIG. 2 is a side elevational view of the mounting assembly shown in FIG. 1.

A mounting assembly in accordance with the subject invention is identified generally by the numeral 10 in FIGS. 1-8. The mounting assembly 10 includes a release liner 12 and a holder 14. The release liner 12 in the embodiment illustrated in FIGS. 1-8 is a planar sheet of flexible material such as paper, a resin material, a fabric or the like. The release liner 12 includes a top surface 16 with a release coating formed thereon. The release coating may be a silicone-based product or other release materials that are known to those skilled in the art. In the embodiment of FIGS. 1-8, the release liner is substantially rectangular and slightly larger than the holder 14 so that a substantially uniform border extends between the periphery of the holder 14 and the periphery of the release liner 12. The extension of the release liner 12 in at least one direction beyond the periphery of the holder 14 leads to an efficient use of the mounting assembly 10 as explained herein. However, a uniform border between the peripheries of the release liner 12 and the holder 14 is not essential, and the peripheries of the release liner 12 and the holder 14 could be registered along at least one edge. Additionally, other more rectangular configurations of the release liner 12 are considered in the descriptions of alternate embodiments presented below.

The holder 14 also is a sheet of flexible material and may be paper, a resin or a laminate. The rectangular shape for the holder 14 shown in FIG. 1 is only one of many possible configurations as explained further below.

The holder 14 includes a rear surface 18 and a front surface 20. A coating of a non-marring, removable and repositionable pressure sensitive adhesive is applied to the entire rear surface 18 of the holder 14. Most removable pressure sensitive adhesives achieve their removability due to the plasticizers in the adhesive. However, the plasticizers used in most removable pressure sensitive adhesives lose their effectiveness slowly over time and become fairly permanent after several weeks or months. Thus, many removable adhesives will mar the surface to which they are applied or will leave a residue after being positioned for several weeks or months. Repositionable microspheric adhesives are used in the Post-it® notes sold by 3M. However, these provide a very light tack to permit easy and clean removal. These types of products, however, are not designed to have an inherent ability to permanently grip. In contrast, the adhesive applied to the rear surface 18 of the holder 14 should be able to provide a substantially permanent attachment, if desired, while retaining an ability to be separated cleanly from both an object and a substrate without damaging either and without leaving a residue. The adhesive applied to the rear surface 18 of the holder preferably is predominantly a water-based emulsion which may be adapted microspherically to allow the necessary tackiness to accomplish the shear qualities (i.e., the ability to hold or to give up a grip) between both a substrate and an object to be held on the substrate. The particular adhesive will vary depending upon the surface characteristics of both the substrate and the object to be held on the substrate and the weight of the object. One adhesive that has been found suitable for many applications is the T1055 adhesive available from Nastar, Inc. of Middleton, Wis. The Nastar T1055 adhesive has proved to have the necessary hold and release characteristics when used with a broad range of paper and plastic objects applied to a correspondingly broad range of substrates, including wood, metal, glass, paper and plastic. The components of the adhesive and the microspheric encapsulations therein combine to achieve a continued freshness of components to allow the permanent adhesion to release cleanly. The T1055 adhesive of Nastar, Inc. is only one of several adhesives that can be applied to the rear surface 18 of the holder 14. The adhesive acts as a permanent adhesive when applied to a surface and hence will enable the holder 14 to be affixed substantially permanently to the surface. However, the adhesive also permits the holder 14 to be separated from even delicate surfaces, such as paper newsprint, wall paper, painted surfaces, wood or mirrors without damaging the surface. Additionally, the adhesive will not leave a residue on the surface and will retain sufficient tackiness to be repositioned adhesively on another surface or at another location on the original surface. The front surface 20 of the holder 14 has no adhesive and can be printed with appropriate indicia or laminated with a desired material. The laminate applied to the front surface 20 can be smooth or textured depending upon the aesthetic objectives of the user.

A U-shaped die cut 22 is formed through the holder 14. The U-shaped die cut includes opposite ends 24 and 26. Portions of the die cut 22 between the ends 24 and 26 are defined by three straight lines that intersect consecutively at right angles in the illustrated embodiments of FIGS. 1-8. However, a differently configured die cut 22 can extend between the ends 24 and 26. For example, a generally semi-circular die cut can be provided. As explained further below, the die cut can take many other configurations depending upon the intended use of the holder.

The numeral 28 defines a fold area extending between the ends 24 and 26 of the die cut 22. The fold area 28 need not be defined by a score line, perforation array or any other substantially permanent feature of the holder 14. However, the line 28 is intended to denote an area of the holder 14 at which a fold or temporary deflection can be carried out. The area of the holder 14 between the end points 24 and 26 of the die cut 22 and bounded by the remainder of the die cut 22 defines a flap 30 that can be deflected relative to the remainder of the holder 14 about the area denoted by the broken line 28. The remainder of the holder outside the area of the flap 30 is identified generally by the numeral 32 and is referred to herein as the foot. In the embodiment of FIGS. 1-8, the foot 32 is a generally rectangular frame-shaped region. However, other configurations are possible, as explained below.

The flap 30 and the foot 32 perform two distinct functions for the holder 14. In particular, the adhesive on the portion of the rear surface 18 of the holder 14 defining the foot 32 will secure the holder 14 to a substrate, while permitting selective removal and repositioning of the holder 14. On the other hand, the adhesive on the portion of the rear surface 18 of the holder 14 that defines the flap 30 will be used to secure another object to the holder 14. Thus, for example, the foot 32 can be used to secure the holder 14 to a wall while the flap 30 is used to secure a photograph, poster, calendar or the like to the holder 14.

Figure 3:
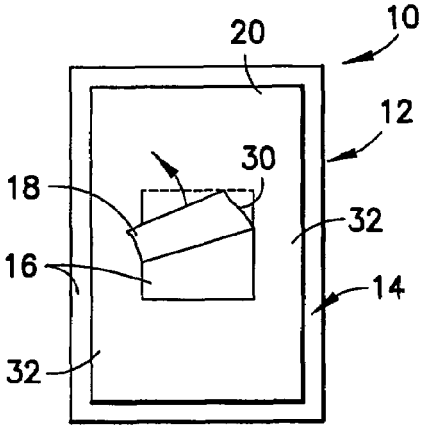
FIG. 3 is a top plan view of the mounting assembly with the flap partly lifted from the remainder of the mounting assembly.
Figure 4:
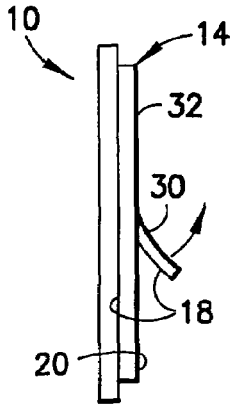
FIG. 4 is a side elevational view of the mounting assembly in the condition shown in FIG. 3.
Figure 5:
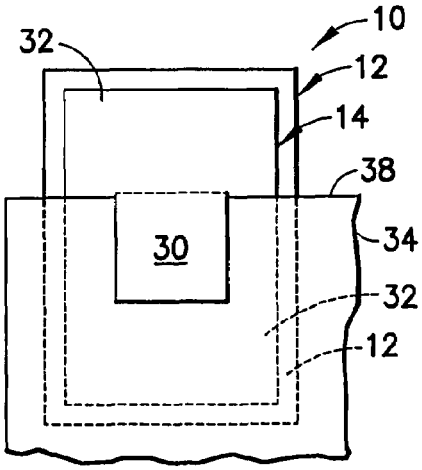
FIG. 5 is a top plan view of the mounting assembly mounted to an object.
Figure 6:
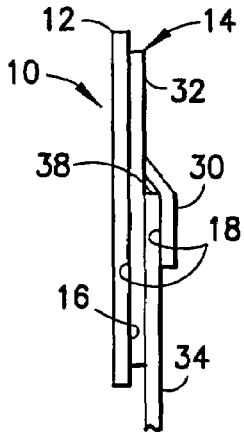
FIG. 6 is a side elevational view of the mounting assembly on the object as shown in FIG. 5.
Figure 7:
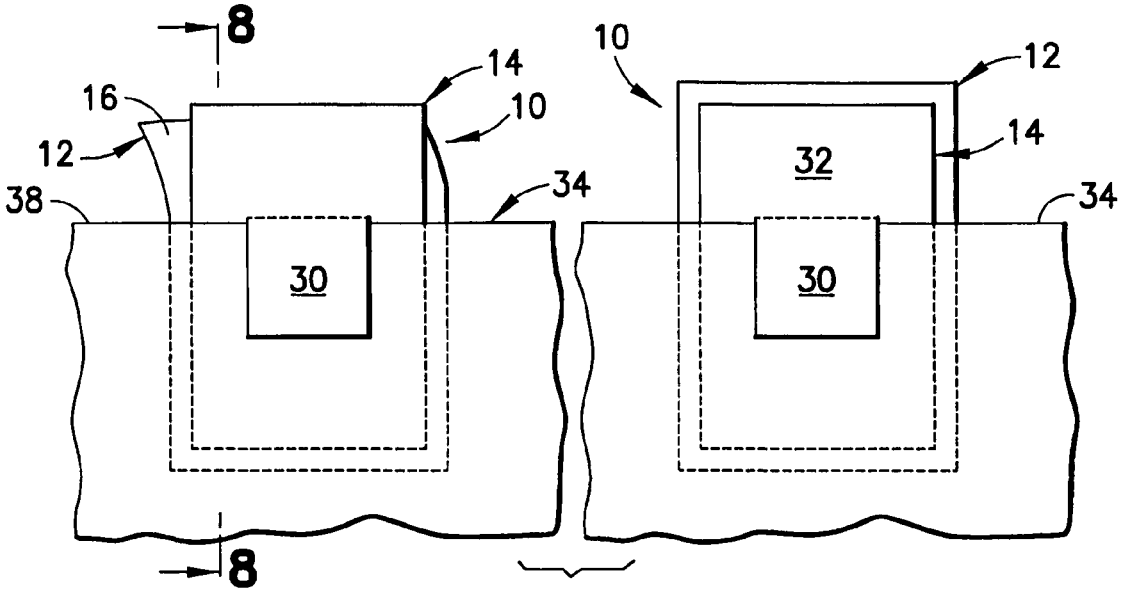
FIG. 7 is a top plan view of a plurality of mounting assemblies mounted to a single object.
Figure 8:
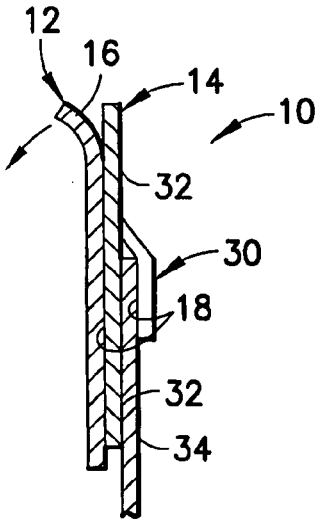
FIG. 8 is a cross-sectional view taken along line 8-8 in FIG. 7.
Figure 9:
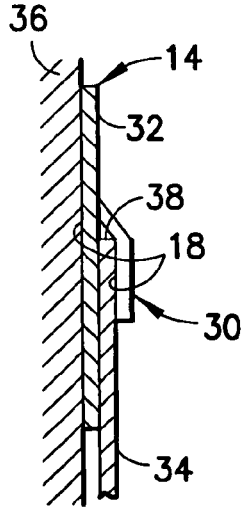
FIG. 9 is a cross-sectional view showing the holder and the object mounted to a substrate.

The mounting assembly 10 is used by first flexing the assembly 10 sufficiently to flex the flap 30 away from the foot 32 and away from the release liner 12, as shown in FIGS. 3 and 4. The flap 30, however, remains attached to the foot 32 along the connection area 28. The mounting assembly 10 then may be used as shown in FIGS. 5-9. More particularly, FIGS. 5-9 illustrate a method for using the mounting assembly 10 to secure a generally planar object 34 to a wall or other vertical substrate 36. In this regard, the mounting assembly 10 is slid adjacent to an edge of the object 34 so that the flap 30 is opposed to the front surface region of the object 34 near the edge 38. Portions of the mounting assembly 10 outside the die cut 22 slide adjacent to a rear face of the object 34 adjacent the edge 38. The flap 30 then is pressed against the front face of the object 34. Thus, the mounting assembly 10 is securely, but releasably and repositionably, attached to the object 34. At this point, the release liner 16 preferably remains attached to all of the rear surface 18 of the holder 14 except for a portion of the rear surface 18 on the flap 30. Several mounting assemblies 10 may be secured to the object 14 as shown in FIG. 7.

The number and relative positions of the mounting assemblies 10 will depend upon the weight of the object 34 and surface characteristics of the substrate 36. The object 34 can be held manually on the substrate to assess the positioning, alignment and overall appearance. The user then peels the release liner 16 from the holder 14 as shown schematically in FIG. 8 and presses the foot 32 against the substrate. This procedure may be carried out sequentially for those situations shown in FIG. 7 where more than one mounting assembly 10 is employed. In the mounted condition, the flap 30 and portions of the foot 32 above the flap 30 will be visible. However, remaining portions of the foot 32 will be concealed behind the object 34.

The relative dimensions of the flap 30 and the foot 32 are defined by the length of the cut 22 and are selected to ensure that the object 34 will be anchored to the flap or flaps 30 and to ensure that the foot or feet 32 will remain securely anchored to the substrate 36 despite the weight of the object 34. In most situations, a vertical substrate 36, such as a wall, door or window will provide a less favorable surface for adhesion. As a result, the total surface area of the foot 32 generally will be significantly larger than the surface area defined by the flap 30. In most situations, the flap 30 will define a surface area of between about 15%-30% of the surface area of the foot 32, and preferably the flap 30 will define an area of about 20% the area of the foot. This latter preferred ratio will occur, for example, if the flap is a 1×1 square while the entire holder is a 2×3 rectangle. However, variations of these relative dimensions are possible depending upon characteristics of the substrate and the objects.

Figure 10:
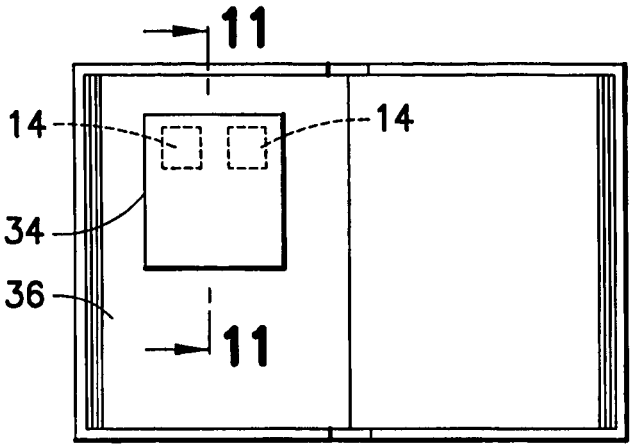
FIG. 10 is a top plan view of an alternate use of the holder shown in FIGS. 1-9.
Figure 11:
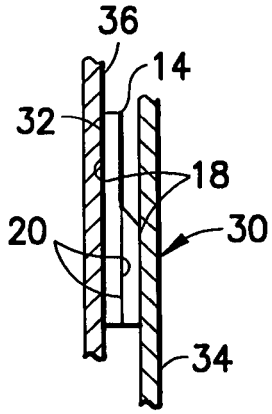
FIG. 11 is a cross-sectional view taken along line 11-11 in FIG. 10.

The mounting assembly 10 shown in FIGS. 1-4 can be used in other ways and for other types of objects. For example, there may be instances where neither the flap 30 nor the area of the foot 32 above the flap should be visible. This may occur, for example, when mounting a photograph in an album. In this situation, the flap 30 can be rotated approximately 180° about the fold area 28 so that the portion of the front surface 20 of the holder 14 on the flap 30 lies in face-to-face engagement with a portion of the front surface 20 on the foot 32. The adhesive on the portion of the rear surface 18 extending across the flap 30 then can be secured to the rear surface of the object 34. The release liner 16 then is peeled away from the foot 32 and the object 34 is secured to the substrate 36 in the manner shown in FIGS. 10 and 11. As a result, the entire folder 14 is concealed by the object 34. FIGS. 10 and 11 show this mounting method as applied to a small object 34, such as a photograph, secured to a substrate 36, such as an album. However, this mounting method can be used with relatively small objects 34 to be hung on a vertical substrate 36.

Figure 12:
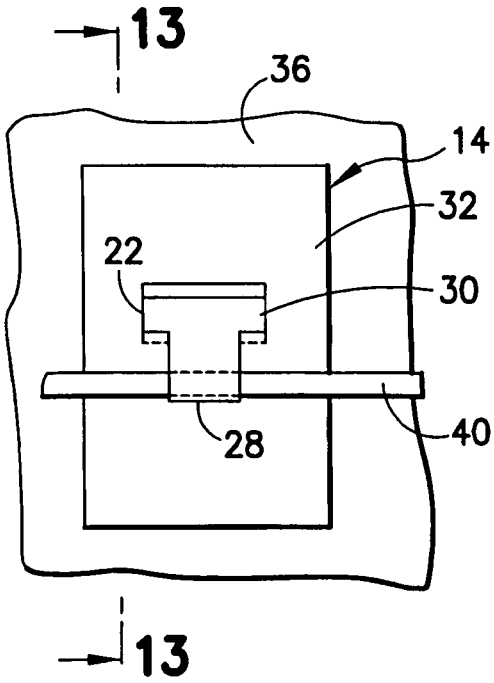
FIG. 12 is a top plan view of a further alternate use of the holder shown in FIGS. 1-9.
Figure 13:
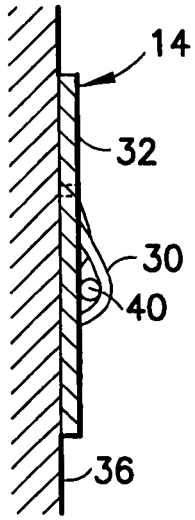
FIG. 13 is a cross-sectional view taking along line 13-13 in FIG. 12.

The mounting assembly 10 also can be used to secure non-planar objects to a substrate. For example, as shown in FIGS. 12 and 13, the holder 14 can be secured to a vertical substrate 36 so that the fold area 28 between the flap 30 and the foot 32 is below the die cut 22 that defines the flap 30. The flap 30 then is rotated generally about the fold area 28 and away from the substrate 36. A non-planar object 40, such as a telephone wire, a speaker wire or a mounting hook of a decoration then is placed between the front surface 20 of the foot 32 and the rear surface 18 of the flap 30. The portion of the rear surface 18 on the flap 30 then is urged back against the substrate so that the non-planar object 40 is held to the substrate. In this embodiment, the cut 22 is configured to define a T-shaped flap 30. A wide area of the T-shaped flap 30 farthest from the fold area 28 can be adhered to the substrate 36. Areas of the foot 32 that had been adjacent the narrow part of the flap 30 then can overlie the wide area of the T-shaped flap 30. Thus, the foot 32 helps to secure the flap 30 in place and more securely holds the non-planar object 40 on the substrate 36.

Figure 14:
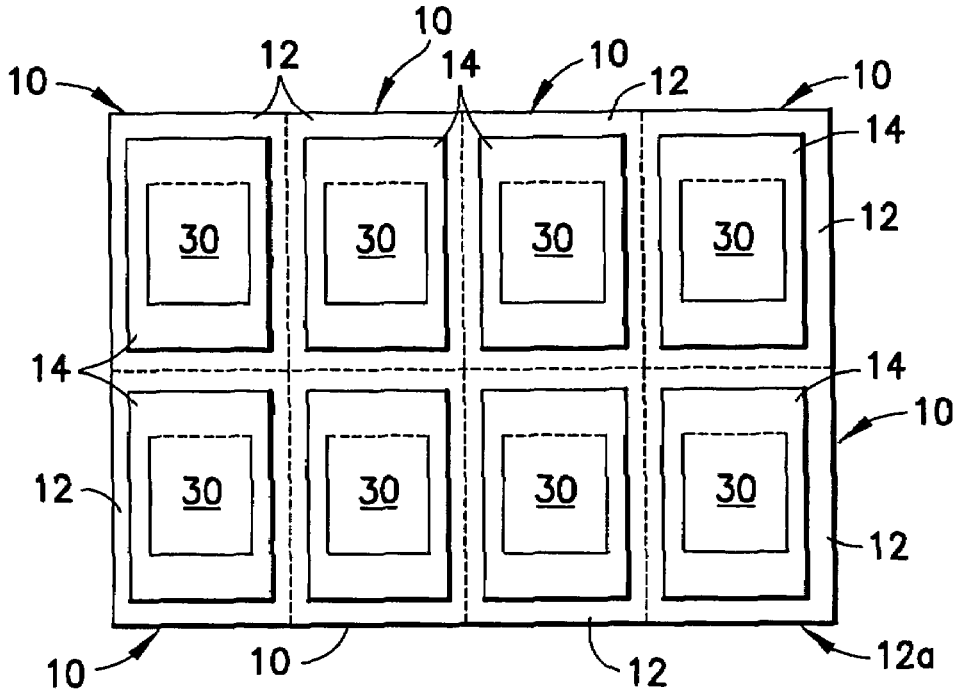
FIG. 14 is a top plan view of a release sheet carrying a plurality of holders.

FIGS. 1-8 show a mounting assembly where a single holder 14 is mounted to a release liner. However, several holders 14 may be mounted to a single release liner 12*a* to form a mounting assembly 10*a* as shown in FIG. 14. In this embodiment, the release liner 12*a* preferably is formed with an array of perforations 42 so that the single release liner 12*a* can be severed along the perforation arrays 42 to form a plurality of mounting assemblies 10 as described and illustrated above.

Figure 15:
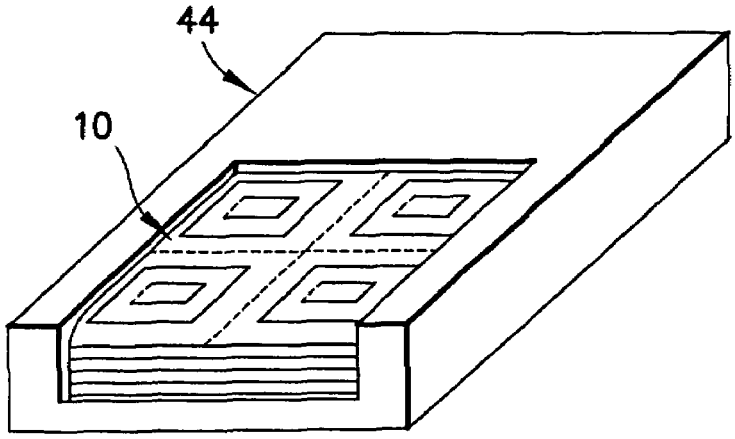
FIG. 15 is a perspective view of a dispensing package for the mounting assemblies of FIG. 1 or 14.
Figure 16:
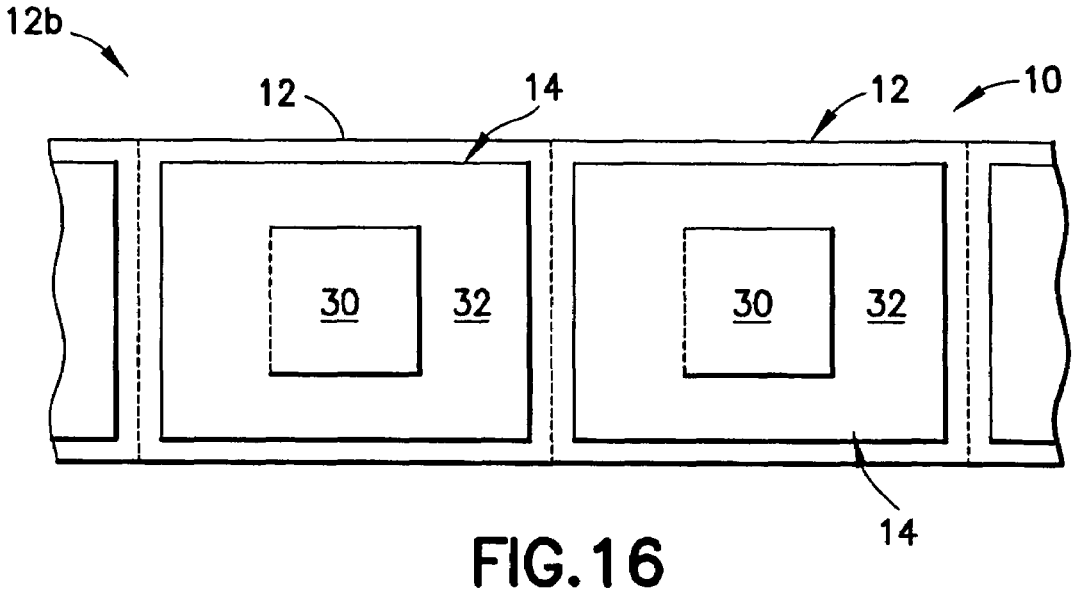
FIG. 16 is a top plan view of a strip-shaped array with a plurality of interconnected mounted assemblies.

The mounting assembly 10 or 10*a* can be packaged and stored in a dispenser pack 44, as shown in FIG. 15. Thus, mounting assemblies 10 or 10*a* can be withdrawn from the dispenser pack 44 as needed, while the remainder of the mounting assemblies 10, 10*a* can be stored until needed. Of course, other packaging arrangements can be provided, including blister packs, plastic bags and the like.

The mounting assemblies 10 also can be interconnected along a release liner strip 12*b*. Perforation arrays 46 separate the mounting assemblies 10 from one another and can be severed as needed. The strip 16*b* can be stored in a roll form or can be folded and stacked.

Figure 17:
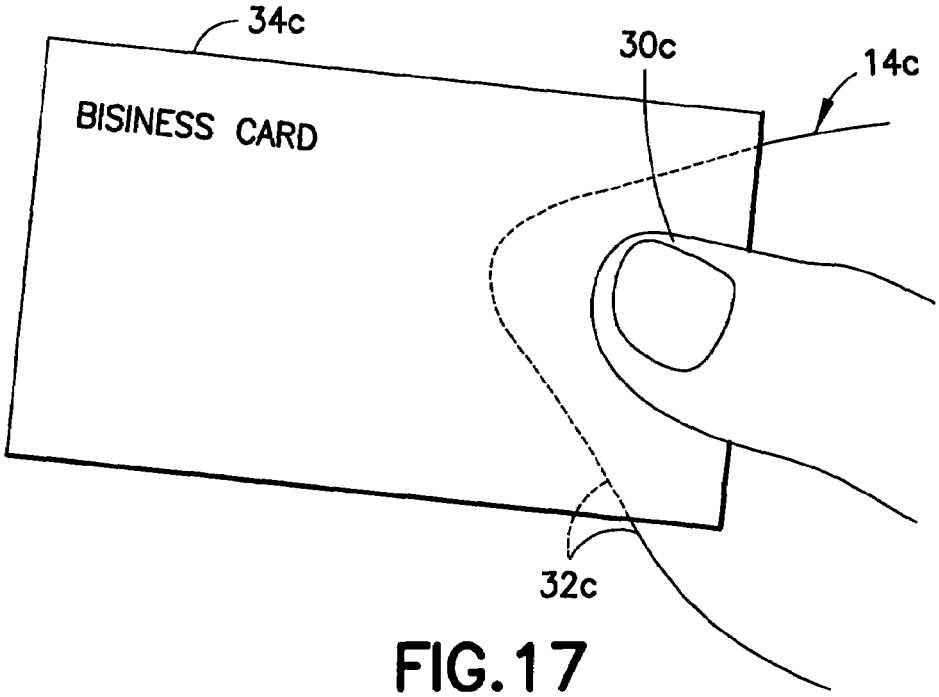
FIG. 17 shows one optional alternate configuration for the holder.

All of the mounting assemblies shown in FIGS. 1-16 have generally rectangular holders 14 secured to generally rectangular release liners 12. However, neither the holders 14 nor the release liners 12 need be rectangular. For example, FIG. 17 shows a holder 14*c* generally in the shape of a human hand. The holder 14*c* may be a laminated sheet with a top layer printed to resemble a hand. The holder 14*c* includes a flap 30*c* and a foot 32*c*. The flap 30*c* is on a portion of the holder that is printed to resemble the thumb of the hand. The foot 32*c* resembles the remainder of the hand. The release liner 58 can take any convenient form. The holder 52 shown in FIG. 17 will give the appearance of a person holding the object 34*c*.

Figure 18:
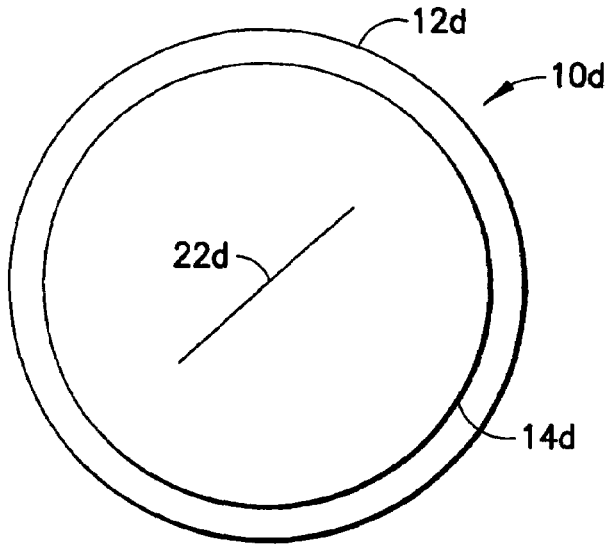
FIG. 18 is a top plan view of a further alternate mounting assembly.
Figure 19:
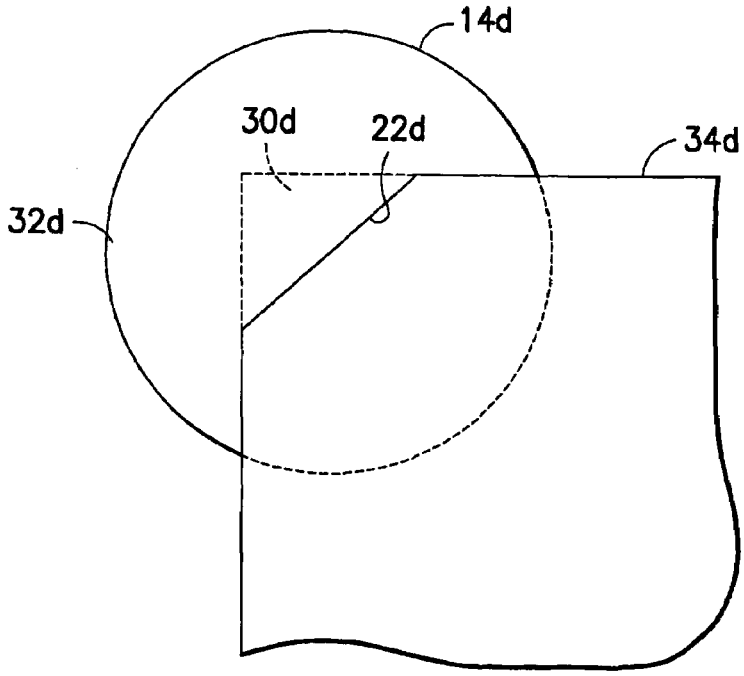
FIG. 19 shows the holder of the mounting assembly depicted in FIG. 18 in use for holding an object.

FIG. 18 shows a mounting assembly 10*d* with a release liner 12*d* and a holder 14*d*. The release liner 12*d* may be identical to the release liner 10 described and illustrated above and the holder 14*d* can be very similar to the holder 14 described and illustrated above. However, the holder 14*d* has only a single linear cut 22*d*. In the illustrated embodiment, the holder 14*d* is substantially rectangular and the cut 22*d* is aligned at an acute angle to the edges of the holder 14*d*. The holder 14*d* is particularly well suited for holding relatively lightweight planar objects, such as photographs, recipe cards or the like to a substrate, and particularly a book, album or the like. As shown in FIG. 19, the corner of a sheet-like planar object 34*d* is passed through the linear cut 22*d*. Thus, a virtual triangular flap is defined adjacent the cut 22*d*, with the cut 22*d* defining the hypotenuse of the triangle. The remainder of the holder 14*d* defines the foot 32*d*.

While the invention has been described with respect to certain preferred embodiments, it is apparent that various changes can be made without departing from the scope of the invention as defined by the appended claims.

What is claimed is:

1. A mounting assembly in combination with a substantially flat object for mounting the object on a substrate, the mounting assembly comprising: a substantially flat object having a rear surface for facing the substrate and a front surface for facing away from the substrate; a holder sheet formed from a flexible material and having opposite front and rear faces, a repositionable adhesive being applied substantially completely across the whole rear face of the holder sheet, a non-linear cut being formed through the holder sheet at locations spaced inwardly from peripheral edges of the holder sheet to define a flap and a foot surrounding the flap, portions of the rear surface of the holder sheet defining the flap being repositionably secured to the front surface of the object, portions of the front surface of the holder sheet on sections of the foot adjacent the non-linear cut engaging a portion of the rear surface of the object; and a release liner being secured removably to portions of the rear surface of the holder sheet defining the foot, whereby the release liner can be removed so that the repositionable adhesive on the foot can be repositionably attached to the substrate.

2. The assembly of claim 1 wherein a major portion of the flap is substantially parallel to the object and to the foot.

3. The assembly of claim 1, wherein the cut in the holder is substantially U-shaped.

4. The assembly of claim 1, wherein the holder is formed from paper.

5. The assembly of claim 1, wherein the holder is formed from resin film.

6. The mounting assembly of claim 1 further comprising indicia printed on the front face of the holder.

7. A method of mounting a holder sheet to a substantially flat object and to a substrate, the substantially flat object having opposite front and rear faces, the method comprising:

providing a mounting assembly with a holder sheet having opposite front and rear surfaces, a repositionable adhesive being applied continuously across the whole rear surface, a non-linear cut extending through the holder sheet at locations inwardly from peripheral edges of the holder sheet so that the cut defines a flap, portions of the holder sheet surrounding the flap defining a foot, the mounting assembly further comprising a release liner removably secured to the rear surface of the holder sheet;

flexing the mounting assembly to lift the flap away from the release liner;

placing the flat object between a portion of the rear surface of the holder sheet corresponding to the flap and a portion of the front surface of the holder sheet corresponding to the foot so that the flap is opposed to the front face of the flat object and so that the rear face of the flat object is opposed to a portion of the foot;

pressing the flap against the object so that the repositionable adhesive repositionably adheres to the front face of the flat object;

removing the release liner from the holder sheet; and pressing the rear face of the holder sheet against the substrate for repositionably securing the foot to the substrate.

8. The method of claim 7, wherein the step of providing at least one mounting assembly comprises providing a plurality of mounting assemblies, the flaps of each of the plurality of mounting assemblies being repositionably secured to the object, the release liners of each of the plurality of mounting assemblies then being removed from the holder sheets and the holder sheets being pressed against the substrate so that the feet defined on the plurality of holder sheets secure the object to the substrate.

9. The method of claim 7, wherein the flap is attached to the foot along a fold area, and wherein the step of attaching the flap to the object is carried out so that an edge of the object is substantially adjacent the fold area.

* * * * *